US007582820B2

(12) United States Patent
Millender, Jr. et al.

(10) Patent No.: US 7,582,820 B2
(45) Date of Patent: Sep. 1, 2009

(54) METHOD AND APPARATUS FOR OPTIMIZING SOUND OUTPUT CHARACTERISTICS OF A BASS DRUM

(76) Inventors: Samuel Earl Millender, Jr., 419 Riviera Dr., San Rafael, CA (US) 94901; Jesse M. Bradman, 3150 I Street Extension, Suite D, Petaluma, CA (US) 94952; William (Billy) L. Johnson, 427 Lagunitas Ave., #104, Oakland, CA (US) 94610

( * ) Notice: Subject to any disclaimer, the term of this patent is extended or adjusted under 35 U.S.C. 154(b) by 3 days.

(21) Appl. No.: 12/072,867

(22) Filed: Feb. 28, 2008

(65) Prior Publication Data

US 2008/0210078 A1 Sep. 4, 2008

Related U.S. Application Data

(60) Provisional application No. 60/904,619, filed on Mar. 2, 2007.

(51) Int. Cl.
*G10D 13/02* (2006.01)

(52) U.S. Cl. ..... 84/411 R; 84/411 M

(58) Field of Classification Search ..... 84/411 R, 84/411 M

See application file for complete search history.

(56) References Cited

U.S. PATENT DOCUMENTS 3,026,759 A * 3/1962 Kleiner et al. ..... 84/411 R
4,742,753 A * 5/1988 Speed ..... 84/414
5,095,796 A * 3/1992 Genna ..... 84/414
5,583,307 A * 12/1996 Tobia, Jr. ..... 84/411 R
5,986,196 A * 11/1999 Behrenfeld ..... 84/411 M
6,172,289 B1 * 1/2001 Shelley ..... 84/411 R
6,677,512 B1 * 1/2004 Chen ..... 84/411 R
6,700,044 B1 * 3/2004 Bencomo, Jr. ..... 84/411 R
7,256,342 B2 * 8/2007 Hagiwara et al. ..... 84/726
2008/0078279 A1 * 4/2008 Belli ..... 84/411 R
2008/0210078 A1 * 9/2008 Millender et al. ..... 84/411 M

* cited by examiner

*Primary Examiner*—Jeffrey Donels
*Assistant Examiner*—Robert W Horn
(74) *Attorney, Agent, or Firm*—Bruce H. Johnsonbaugh

(57) ABSTRACT

An apparatus and method are provided for maximizing the punch of a bass kick-drum and simultaneously minimizing the ringing of the drum. An insert is provided having a cylindrically shaped body adapted to be slid into a conventional circular opening formed in the resonant membrane of the drum. The cylindrical insert is held in contact with the resonant membrane by one of several mounting techniques. The weight of the insert and the length and diameter of the body of the insert are sized in a manner to lower the fundamental frequency of the resonant membrane and to increase the amplitude of the fundamental resonant frequency and to simultaneously dampen the vibration of the resonant membrane, which three factors are all part of increased "punch." The ringing of the drum is minimized by quickly dampening the vibration of the resonant membrane wherein the increased dampening is caused by the weight and shape of the insert. A method of optimizing the sound of the drum is provided whereby the sizing of the insert is adjusted to maximize the punch and minimize the ring of the resonant membrane.

9 Claims, 7 Drawing Sheets

| Frequency (Hz) | Level (dB) |
|---|---|
| 2.691650 | -15.399669 |
| 5.383301 | -12.958247 |
| 8.074851 | -16.869579 |
| 10.766602 | -15.573738 |
| 13.458252 | -17.695242 |
| 16.149902 | -19.594408 |
| 18.841553 | -15.819436 |
| 21.533203 | -16.369389 |
| 24.224854 | -16.430656 |
| 26.916504 | -18.418894 |
| 29.608154 | -17.511284 |
| 32.299805 | -24.226973 |
| 34.991455 | -15.848245 |
| 37.683105 | -13.078207 |
| 40.374756 | -7.037069 |
| 43.066406 | 6.436262 |
| 45.758057 | 7.171702 |
| 48.449707 | -3.597107 |
| 51.141357 | -20.297657 |
| 53.833008 | -22.861498 |
| 56.524658 | -26.228331 |
| 59.216309 | -20.360050 |
| 61.907959 | -23.966084 |
| 64.599609 | -16.536827 |
| 67.291260 | -21.498249 |
| 69.982910 | -18.521101 |
| 72.674561 | -24.545492 |
| 75.366211 | -17.564306 |
| 78.057861 | -15.723179 |
| 80.749512 | -7.607484 |
| 83.441162 | -2.536982 |
| 86.132812 | -4.747409 |
| 88.824463 | -10.262620 |
| 91.516113 | -27.380264 |
| 94.207764 | -24.692087 |
| 96.899414 | -24.491060 |
| 99.591064 | -29.316032 |

*FIG. 5A*

| Frequency (Hz) | Level (dB) |
|---|---|
| 2.691650 | -12.515442 |
| 5.383301 | -12.761276 |
| 8.074951 | -18.908937 |
| 10.766602 | -20.605919 |
| 13.458252 | -15.285405 |
| 16.149902 | -13.414198 |
| 18.841553 | -12.503620 |
| 21.533203 | -16.708437 |
| 24.224854 | 0.959358 |
| 26.916504 | 11.435563 |
| 29.608154 | 9.514885 |
| 32.299805 | -8.274984 |
| 34.991455 | -16.251287 |
| 37.683105 | -14.722428 |
| 40.374756 | -23.966784 |
| 43.066406 | -20.617041 |
| 45.758057 | -11.865624 |
| 48.449707 | -5.173912 |
| 51.141357 | -7.232792 |
| 53.833008 | -10.998649 |
| 56.524658 | -2.755937 |
| 59.216309 | 0.600251 |
| 61.907959 | -8.201201 |
| 64.599609 | -18.549685 |
| 67.291260 | -22.321175 |
| 69.982910 | -31.790831 |
| 72.674581 | -31.218538 |
| 75.366211 | -26.733377 |
| 78.057861 | -19.249374 |
| 80.749512 | -16.277218 |
| 83.441162 | -19.283264 |
| 86.132812 | -14.719450 |
| 88.824463 | -13.931905 |
| 91.516113 | -17.979761 |
| 94.207764 | -23.609154 |
| 96.899414 | -34.105541 |
| 99.591064 | -30.286972 |

*FIG. 5B*

| Frequency (Hz) | Level (dB) |
|---|---|
| 2.691650 | -19.833484 |
| 5.383301 | -18.067213 |
| 8.074951 | -17.823944 |
| 10.766602 | -20.777727 |
| 13.458252 | -22.110111 |
| 16.149902 | -19.255875 |
| 18.841553 | -16.612164 |
| 21.533203 | -7.144549 |
| 24.224854 | 9.391105 |
| 26.916504 | 11.039253 |
| 29.608154 | 0.250690 |
| 32.299805 | -14.710054 |
| 34.991455 | -18.452330 |
| 37.683105 | -27.307455 |
| 40.374756 | -20.624546 |
| 43.066406 | -21.911949 |
| 45.758057 | -18.916788 |
| 48.449707 | -18.567080 |
| 51.141357 | -15.798838 |
| 53.833008 | 1.834193 |
| 56.524658 | 6.451140 |
| 59.216309 | 0.265082 |
| 61.907959 | -19.621759 |
| 64.599609 | -25.632128 |
| 67.291260 | -38.028511 |
| 69.982910 | -33.665363 |
| 72.674561 | -41.571747 |
| 75.366211 | -29.510431 |
| 78.057861 | -20.876612 |
| 80.749512 | -14.291144 |
| 83.441162 | -11.821818 |
| 86.132812 | -10.400799 |
| 88.824463 | -6.827597 |
| 91.516113 | -9.284370 |
| 94.207764 | -19.669664 |
| 96.899414 | -27.514036 |
| 99.591064 | -27.080597 |

*FIG. 5C*

METHOD AND APPARATUS FOR OPTIMIZING SOUND OUTPUT CHARACTERISTICS OF A BASS DRUM

CROSS-REFERENCE TO RELATED APPLICATION

This application claims the benefit of and priority from U.S. provisional application Ser. No. 60/904,619 filed Mar. 2, 2007.

INTRODUCTION AND OVERVIEW OF INVENTION

The present invention pertains generally to techniques for optimizing the sound output of a bass kick-drum. The sound output is a factor of the batter head membrane, resonant membrane and space between them, and the resonant characteristics of said components both individually and the interaction of all components combined. As described below, the system of the present invention for the first time adjustably lowers the fundamental resonant frequency of the resonant membrane, increases the amplitude of the fundamental resonant frequency which enhances the bass kick-drum's tonal characteristics, reduces unpleasant or dissonant overtones and undesirable continuation of sound waves, also known as "ringing," by providing an improved dampening feature and dynamically compressing the sound output; all of which are highly desirable improvements over the prior art. Furthermore, the present invention is novel due to its easily removable and portable design in one embodiment, allowing the user the opportunity to use the device by inserting it directly into the resonant chamber through an opening in the resonant membrane of the bass kick-drum without opening the drum.

The present invention, having mass and being coupled to the resonant membrane, increases the mass of the resonant membrane, thereby lowers the resonant membrane's fundamental resonant frequency, and due to its innovative coupling, simultaneously dampens the vibrations known as "ringing," all of which are desirable improvements. Additionally, the invention, constituting a tuned port attached to the resonant membrane and extending into the resonant chamber, furthermore adjustably boosts and enhances the desired frequency characteristics of the bass drum. Furthermore, the invention momentarily restricts the propagation of the sound wave through the opening in the resonant membrane, and, we believe, adds a sonically warm dynamic compression. The result of the foregoing is increased low frequencies, better definition, clarity, a more consistent sound in varying acoustical environments, and increased dynamic impact.

BACKGROUND

Description of Invention

The output sound of a bass drum is inherently much more difficult to optimize than that of a simple string. A vibrating string used in all string instruments is a one dimensional body that vibrates in a second dimension. A vibrating string produces harmonic, pleasant sounding overtones that are integral multiples of the fundamental frequency of the string. "Tuning" or "adjusting the pitch" of the string's fundamental frequency is a simple matter of loosening or tightening the string tension.

In contrast to the vibrating string, a circular bass kick-drum membrane is a two dimensional body that vibrates in a complex fashion described by Bessel function equations in a third dimension. A drum cannot be "tuned" like a vibrating string. As described below, the subject invention allows the user to "tune" or adjust the desired fundamental resonant frequency while concurrently minimizing the undesirable overtones known as "ringing."

When the batter head membrane is struck by the foot pedal, the resonant membrane vibrates and the vibrations include the desired fundamental resonant frequency along with non-harmonic, unpleasant and/or dissonant ringing overtones. These unpleasant overtones are inherent in any circular drum membrane and cannot be removed or reduced by simply adjusting the resonant drumhead tension. The primary dissonant overtone is approximately 2.4 times the fundamental frequency of the drumhead membrane, regardless of the tension applied to the membrane. The above-described dissonant overtones are also produced in bass drums having two drumheads—the resonant and batter head membranes.

If the resonant membrane is allowed to vibrate in an undampened manner, we believe the dissonant undesirable frequency continues which is not only noticeable, but actually interferes with the next sound wave and likely often subsequent sound waves produced when the foot pedal beater strikes the batter head membrane. We also believe that "ringing" moreover occurs as a result of the combination of the inherent, dissonant overtones and an undampened vibration of the resonant membrane. The present invention minimizes "ringing" by quickly dampening the vibration of the resonant membrane.

It is desirable to increase what the percussion industry commonly describes as the "punch" of the bass drum sound output. As used herein and in the claims, the word "punch" is defined to include the following three features: (1) the lowering of the fundamental resonant frequency of the resonant membrane, (2) increasing the amplitude of the fundamental resonant frequency, and (3) increasing the damping of the resonant membrane which reduces undesirable continuation of tone which interferes with subsequent sound waves. These three features can be scientifically measured as described below. In addition to these three measurable features, we believe the invention dynamically compresses the sound output via restriction of sound waves in their exit from the resonant chamber through the resonant membrane.

Lowering the fundamental frequency of the resonant membrane produces a deeper, fuller sound output which is one of the elements of "punch." As is known from Bessel function equations, the fundamental resonant frequency of a circular drum membrane is governed by three variables. The first variable is the diameter of the membrane—the greater the diameter, the lower the fundamental resonant frequency. The second variable is the mass of the vibrating membrane—the greater the mass, the lower the fundamental resonant frequency. The third variable is the tension applied to the drumhead membrane—the greater the tension, the higher the fundamental resonant frequency.

Various prior art techniques have attempted to optimize the bass drum output sound, i.e., reduce the "ringing" and/or increase the "punch" of the bass kick-drum. These techniques generally address either the "ringing" or the "punch" problems individually. For example, the Billings U.S. Pat. No. 4,805,514 requires that the dual membrane bass kick-drum be opened, the device placed inside the drum, adhesively attached and the drum then closed. This prior art device does not have a frequency adjusting capability. Furthermore, it is inconvenient to the drummer who is forced to abandon tuning and other adjustments to open the drum, in addition to the time necessary to accomplish installing the device and then retightening/tuning the drumhead(s).

A further disadvantage of Billings is that the design utilizes a tapered inlet inserted into the resonant chamber which is larger than the circular opening or outlet formed in the resonant membrane. This design projects a large degree of the beater attack on the batter membrane which contains what we believe to be an undesirable increase of high frequencies. As described in more detail below, the present invention utilizes an insert with a cylindrical body that extends into the resonant chamber and which is flared in the opposite direction of Billings and as such focuses and projects the sound output from the resonant chamber into a microphone or acoustical environment.

The present invention provides a novel method and apparatus for lowering the fundamental resonant frequency of a circular bass kick-drum. The drummer is now, for the first time, able to easily maximize the "punch" or a bass kick-drum by adjustably lowering the fundamental resonant frequency. By adding "mass" or "weight" to an insert described below, the user can adjustably lower the fundamental resonant frequency of the resonant membrane.

Additionally, the design of the present invention constitutes a "tuned port" which when inserted provides a novel method of increasing the amplitude of fundamental resonant frequencies of the resonant membrane.

A primary object of the invention is to simultaneously provide dampening which minimizes "ringing," which is the combination of the inherent, dissonant or unpleasant overtones and vibrations of the resonant membrane that otherwise continue to occur and interfere with subsequent sound waves.

A further object of the invention is to provide a novel insert constituting a "tuned port" for a bass kick-drum which simultaneously and adjustably increases the amplitude of the desired fundamental resonant frequency permitting the user to "tune" the sound output while preserving the natural and original acoustic qualities of the bass kick-drum.

A further object of the invention is to provide a novel insert which through the momentary restriction of sound waves in their exit from the resonant chamber, we believe, dynamically compresses the output, which results in a more consistent sound in varying acoustical environments.

A further object of the invention is to provide a novel insert that focuses sound out of the resonant chamber into a microphone.

A further object is to provide a method for adjustably optimizing the output sound of a bass kick-drum by maximizing the "punch" and simultaneously minimizing the "ringing" of the drum.

A final object of the invention is to provide a novel insert that offers a clean, powerful and purposeful aesthetically pleasing look rather than industry standard five inch resonant drum hole opening.

Other objects and advantages will become apparent from the following description of the drawings.

BRIEF DESCRIPTION OF THE DRAWINGS

FIGS. 4A, 4B and 4C are graphical representations comparing the output of a single drum wherein FIG. 4A illustrates the output of the drum without the invention applied, FIG. 4B illustrates the output with one embodiment of the invention applied and FIG. 4C illustrates the output sound with a second embodiment of the invention applied;

FIGS. 5A, 5B and 5C are tables that correspond to the graphs of FIGS. 4A-4C, the tables illustrating decibel levels of various frequencies produced by the vibrating drum head;

DETAILED DESCRIPTION OF THE DRAWINGS

Figure 1:
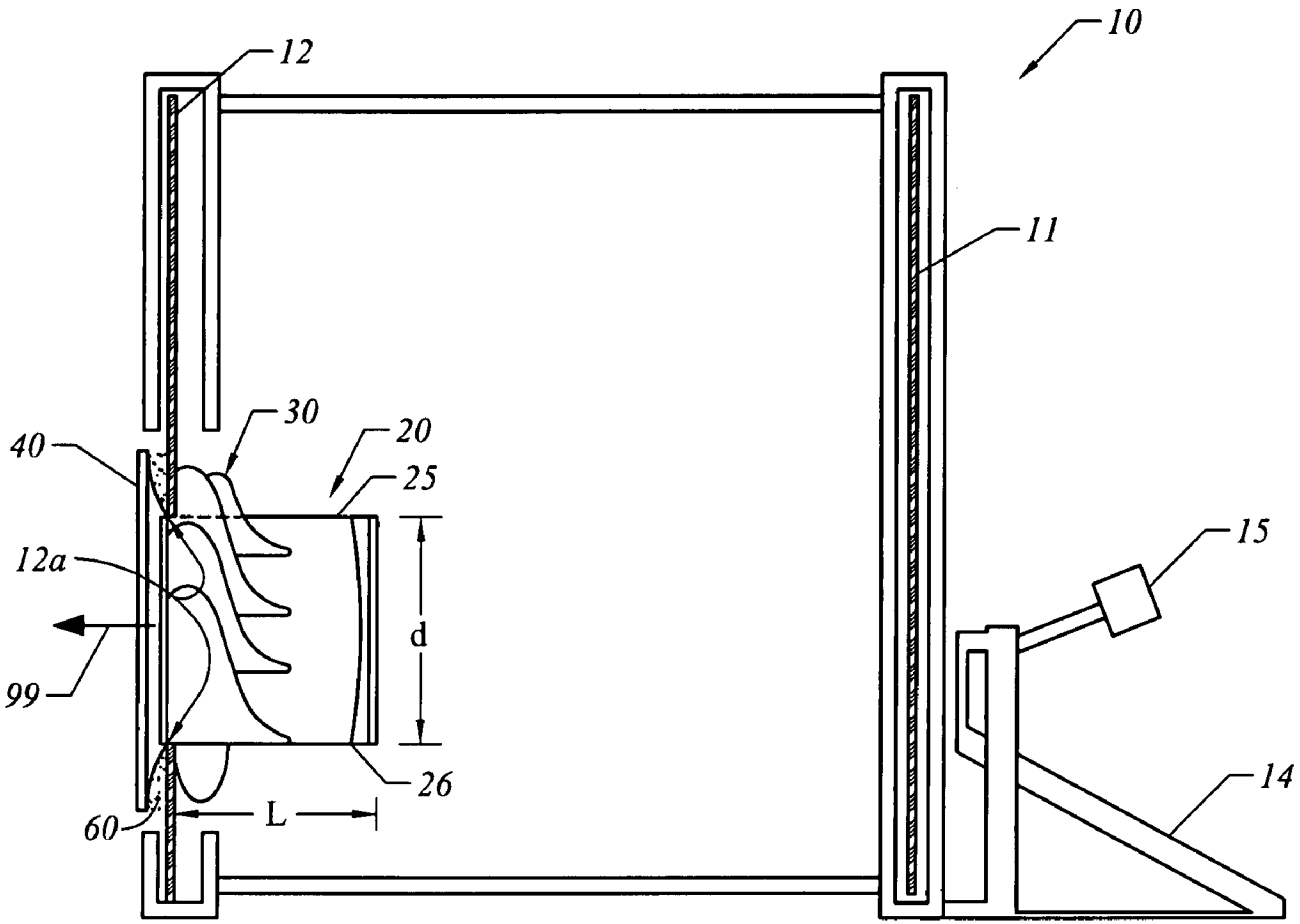
FIG. 1 is a schematic representation of a first embodiment of the invention.

FIG. 1 is a schematic drawing of a first embodiment of the invention. A bass drum shown generally as 10 includes two circular membranes 11 and 12. Membrane 11 is commonly referred to as the batter head membrane and is struck by a conventional base drum pedal 14 and striker or beater 15. The second membrane 12 is commonly referred to as the drum head or resonant membrane and typically has a circular opening 12*a* formed in membrane 12 as is known in the prior art. Opening 12*a*, as is known in the art, is provided to help optimize the sound output of the drum 10.

According to the present invention, a novel removable insert 20 is simply slid into opening 12*a* of membrane 12, and in the first embodiment shown in FIG. 1, slightly rotated and the slight rotation causes a plurality of rubber fins or mounting means 30 to extend outwardly against the inner surface of resonant membrane 12 to attach insert 20 firmly to resonant membrane 12. Other means of attachment are described below.

The insert 20 includes a cylindrical body 25 on which a plurality of fins 30 is mounted. The outer diameter "d" of cylinder 25 is adapted to allow it and fins 30 to slide through opening 12*a* in resonant membrane 12. Insert 20 has a flared flange 40 at its outer end which extends outwardly through membrane 12 and which is outwardly flared in the direction shown by arrows 99. It is significant to note that the weight of insert 20 is carried entirely by resonant membrane 12. As noted above, the weight or mass of insert 20 is added to the mass of membrane 12 and directly reduces the fundamental frequency of membrane 12.

The present invention provides increased "punch" of the drum 10 after each time the pedal 14 is actuated to cause striker 15 to impact the batter head or attack membrane 11 of the drum. The increased "punch" is imparted to the drum by a combination of optimizing the weight of insert 20 for the particular drum and by sizing and shaping the cylindrical body 25 of insert 20 to maximize the amplitude of movement of resonant membrane 12 in response to the striking of attack membrane 11. The insert of the present invention utilizes a cylindrical body 25 in which the inner end 26 of body 25 is the same diameter as the entire portion of the body 25 which is positioned between the resonant membrane 12 and batter head membrane 11. This is in sharp contrast to the bell-shaped or heavily flared bell 10 used in the Billings '514 patent referred to above. The use of the Billings bell 10 tends to direct much of the energy created by the attack membrane through the opening in the resonant membrane. In contrast, the insert of the present invention maximizes the percentage of energy generated by the batter head membrane that is transmitted directly to the resonant membrane 12. The cylindrical body 25 of insert 20 tends to direct all but a small portion of the energy generated by the batter head membrane directly to resonant membrane 12. The length "L" of cylindrical body 20 exceeds its diameter "d." This geometry momentarily restricts sound waves passing through opening 12*a* after the batter head membrane is struck. By sizing the weight, diameter and length of insert 20, adjustment is made to the "punch" of the drum.

If the insert 20 is removed from the drum illustrated in FIG. 1, the "punch" of the drum is reduced for two reasons: First, the mass of the resonant membrane has been reduced significantly by removing the insert and, secondly, the energy generated by striking the batter head membrane passes easily through opening 12*a* in the resonant membrane 12.

The ringing of the drum is minimized by adding the weight of insert 20 to resonant membrane 12. We believe this weight combined with viscous characteristics of insert 20 quickly dampens the sound output which reduces the ringing.

Figure 2B:
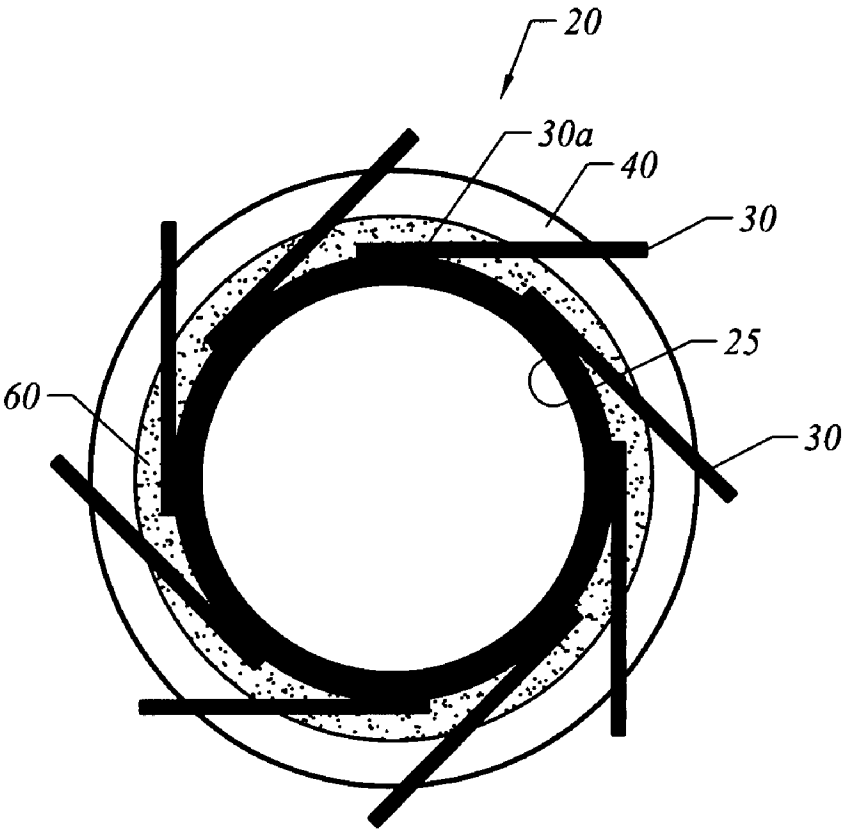
FIGS. 2A and 2B are front and rear views of the insert utilized in FIG. 1 illustrating the insert before it is connected to the drum.
Figure 2A:
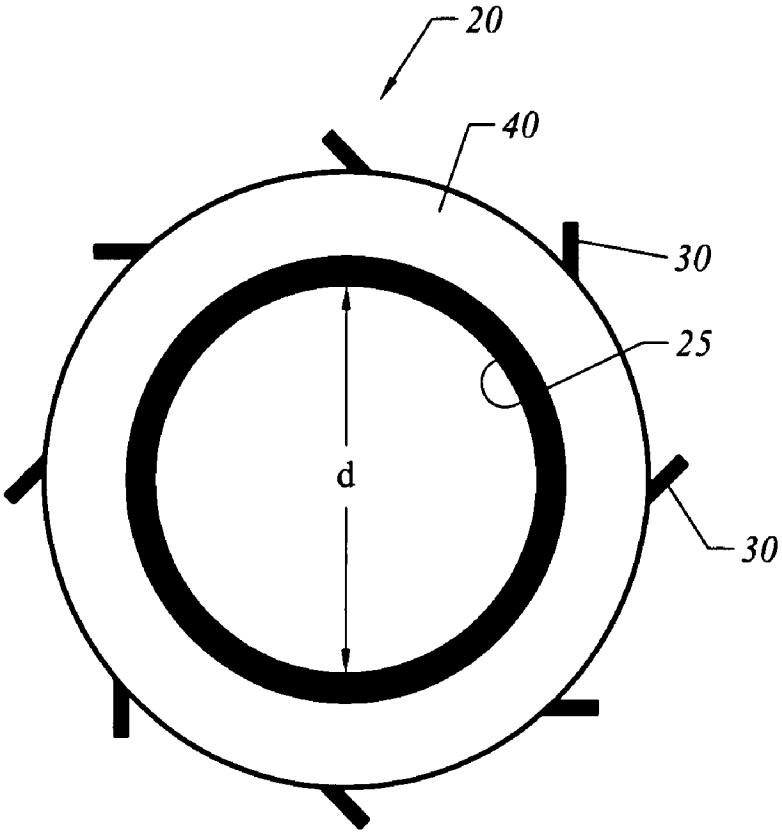

FIGS. 2A and 2B are front and rear views respectively of insert 20 before it is inserted into opening 12*a* of membrane 12. As shown in the front view (FIG. 2A), the flared outer end is a flange 40 which is circular and extends outwardly from cylindrical body 25. The tips of rubber fins 30 are visible extending beyond the outer diameter of flange 40. In the embodiment shown in FIGS. 2A and 2B, the cylindrical body 25 has an inner diameter of four inches and a length of six inches.

As shown in the rear view (FIG. 2B), fins 30 are tangentially attached to cylindrical body 25 at points 30*a* by adhesive. A foam gasket 60 is carried adjacent the flared outer end 40. Foam gasket 60 bears against resonant membrane 12 when insert 20 is attached to membrane 12. Insert 20 is slid into opening 12*a* by simply rotating in a counterclockwise direction, as shown in FIG. 2B, so that the resilient fins 30 can pass through opening 12*a*. Once the insert 20 is slid all the way into opening 12*a* so that gasket 60 bears against resonant membrane 20, insert 20 is simply rotated in a clockwise direction, as shown in FIG. 2B, to cause fins 30 to move outwardly and to grasp membrane 12. Removal of insert 20 is achieved by simply rotating insert 20 in the counterclockwise direction, as shown in FIG. 2B, and sliding it outwardly through opening 12*a*. Fins 30 have a truncated bell-shape so that insert 20 is easily slid into and out of opening 12*a*. Fins 30 are made of rubber having a durometer level of 50 to 55 and having a thickness of 0.125 inch.

Figure 3:
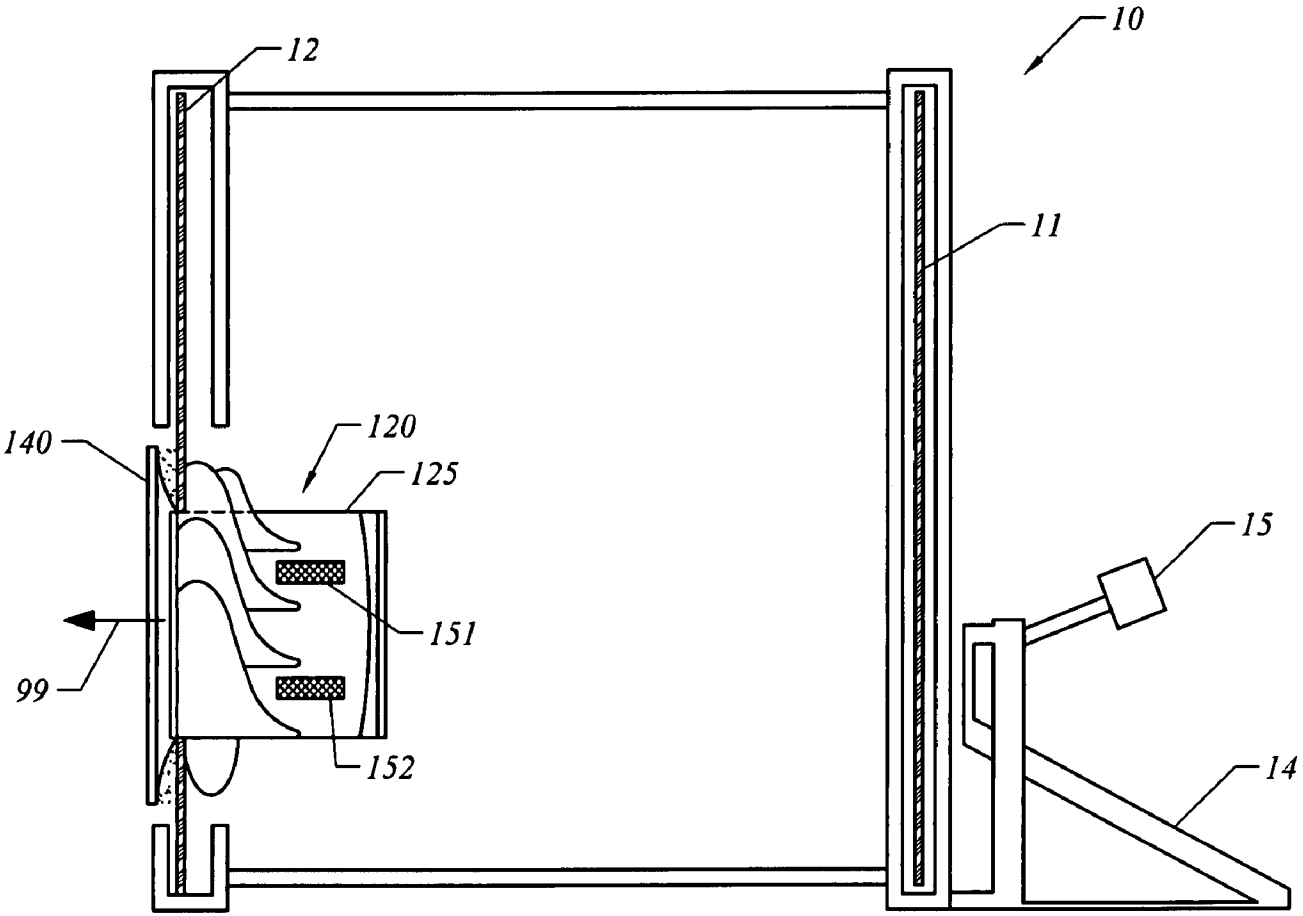
FIG. 3 is a schematic representation of a second embodiment of the invention.

FIG. 3 shows an alternate embodiment of the invention in which bass drum 10 with membranes 11 and 12, as shown in FIG. 1, has an alternate insert 120 installed. Insert 120 differs from insert 20, shown in FIG. 1, in one significant aspect. Insert 120 includes weights 151 and 152, each weighing one ounce, which have been added to the body 125 of insert 120 to increase the overall weight or mass of insert 120.

Figure 4A:
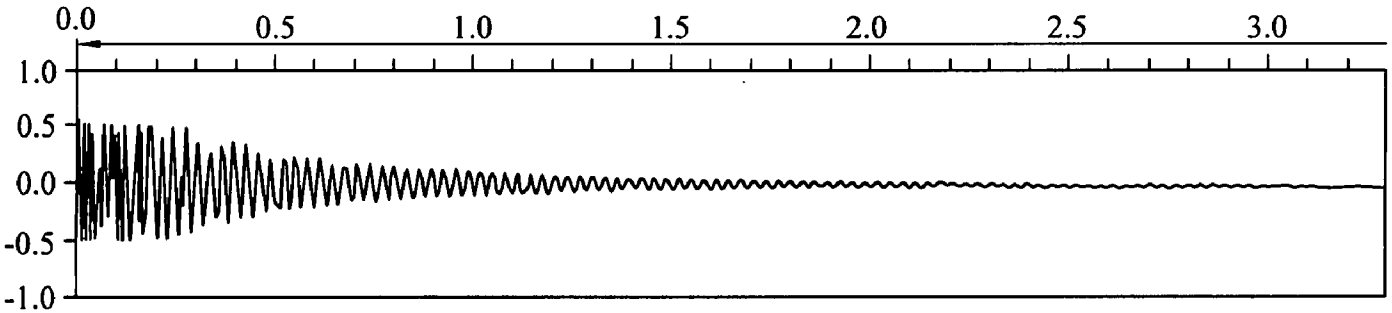
Figure 4B:
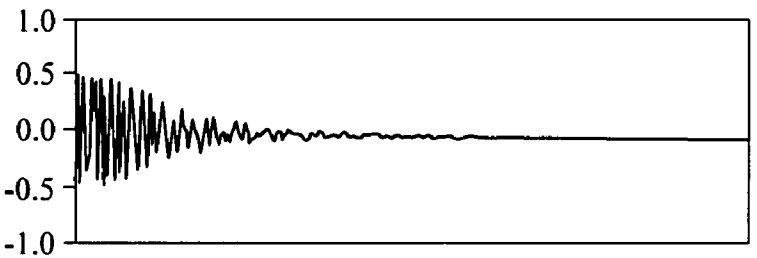
Figure 4C:
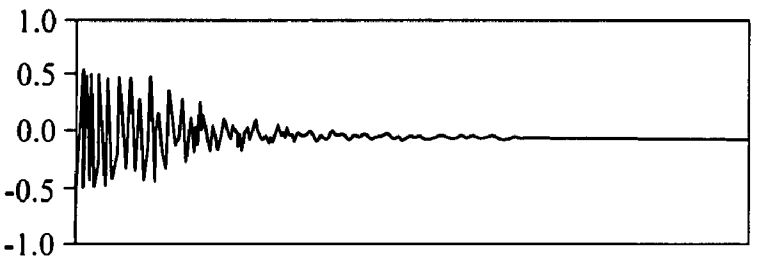

FIGS. 4A, 4B and 4C are graphical representations of sound outputs achieved during laboratory trials. FIGS. 4A-4C illustrate the amplitude of the drum output on the vertical scale as against time in seconds illustrated by the horizontal scale.

FIG. 4A was generated by striking a 22 inch bass kick drum without any insert connected to the resonant membrane. The prolonged vibration of the drum extending for 2 seconds or more illustrates the phenomenon of "ringing."

FIG. 4B illustrates the output of a first embodiment 20 of the present invention (FIG. 1) applied to the same 22 inch drum wherein insert 20 has a weight of 7.35 ounces. As can be seen by FIG. 4B, the output is quickly dampened and the ringing effect, illustrated in FIG. 4A, is quickly ended in less than approximately one-half second.

FIG. 4C illustrates the damping of the second embodiment of the invention (shown in FIG. 3) wherein one ounce was added to insert 120 increasing its weight to 8.35 ounces. The ringing effect is again quickly ended.

The tables shown in FIGS. 5A, 5B and 5C were generated in the laboratory along with graphs shown in FIGS. 4A, 4B and 4C.

The fundamental resonant frequency and amplitudes are represented in FIGS. 5A-5C by taking an average of the two frequencies having the greatest decibel levels and averaging their respective decibels. In FIG. 5A, the two frequencies having the largest amplitudes are 45.75 Hz and 43.06 Hz. The fundamental resonant frequency is therefore approximately 44.4 Hz and the amplitude is the average of 7.17 Db and 6.43 Db, or about 6.8 Db.

FIG. 5A corresponds to FIG. 4A wherein the drum had no insert installed.

The table of FIG. 5B shows that with a first embodiment (FIG. 1) of insert 20 installed, the fundamental frequency of the resonant membrane dropped from 44.4 Hz to approximately 28.3 Hz. This represents more than a 33% lowering of the fundamental frequency of the resonant membrane! It is also significant to note that the output level in decibels increased from 6.8 decibels to about 10.5 decibels which is approximately a 50% increase in the amplitude of vibration of the fundamental frequency at resonant membrane 12. This significantly increases the "punch" of the sound output.

The table of FIG. 5C corresponds to FIG. 4C and illustrates the sound output of insert 120 of FIG. 3 with the addition of one ounce to increase the overall weight of insert 120 to 8.35 ounces. The addition of this weight to insert 120 lowered the fundamental frequency to about 25.6 Hz (about 10%) and slightly decreased the amplitude from about 10.5 decibels to about 10.2 decibels.

The drum utilized to produce the graphs in 4A-4C and tables 5A-5C was a 22 inch diameter bass kick drum. The resonant membrane was made of Mylar film and had an overall weight of 14 ounces. The inserts 20, 120 utilized to produce graphs 4B,4C and tables 5B,5C utilized 8 rubber fins 30. The cylindrical bodies 25, 125 each had an inner diameter of 4 inches and a length of 6 inches. Each rubber fin was made of rubber having a durometer rating of 50-55. The extra weight used in insert 120 (FIG. 3) was added by simply attaching it to cylindrical body 125 with adhesive.

Figure 6:
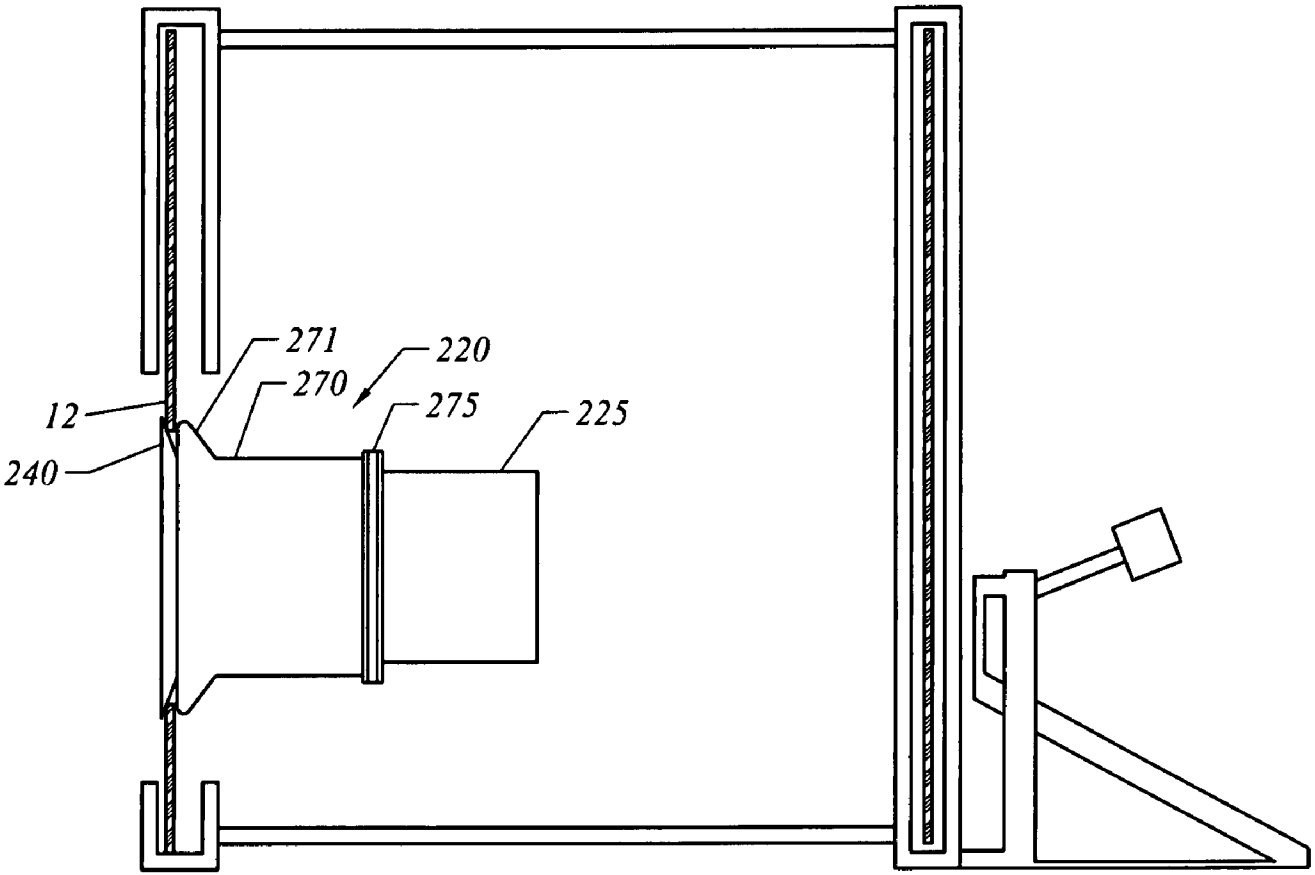
FIG. 6 is a schematic representation of a third embodiment of the invention.

FIG. 6 shows a third embodiment wherein insert 220 has a cylindrical body 225 and a flared outer end with flange 240. A rubber sleeve 270 slides over cylindrical body 225. The forward end of sleeve 270 is flared outwardly to form a peripheral flange 271. Flange 271 contacts resonant membrane 12 so that resonant membrane 12 is engaged firmly between outer flange 240 and peripheral flange 271. Rubber sleeve 270 is held in position by a stop ring 275. The insert 220 must be applied either by opening the drum 10 or by applying it to membrane 12 before membrane 12 is attached to the drum.

Figure 7:
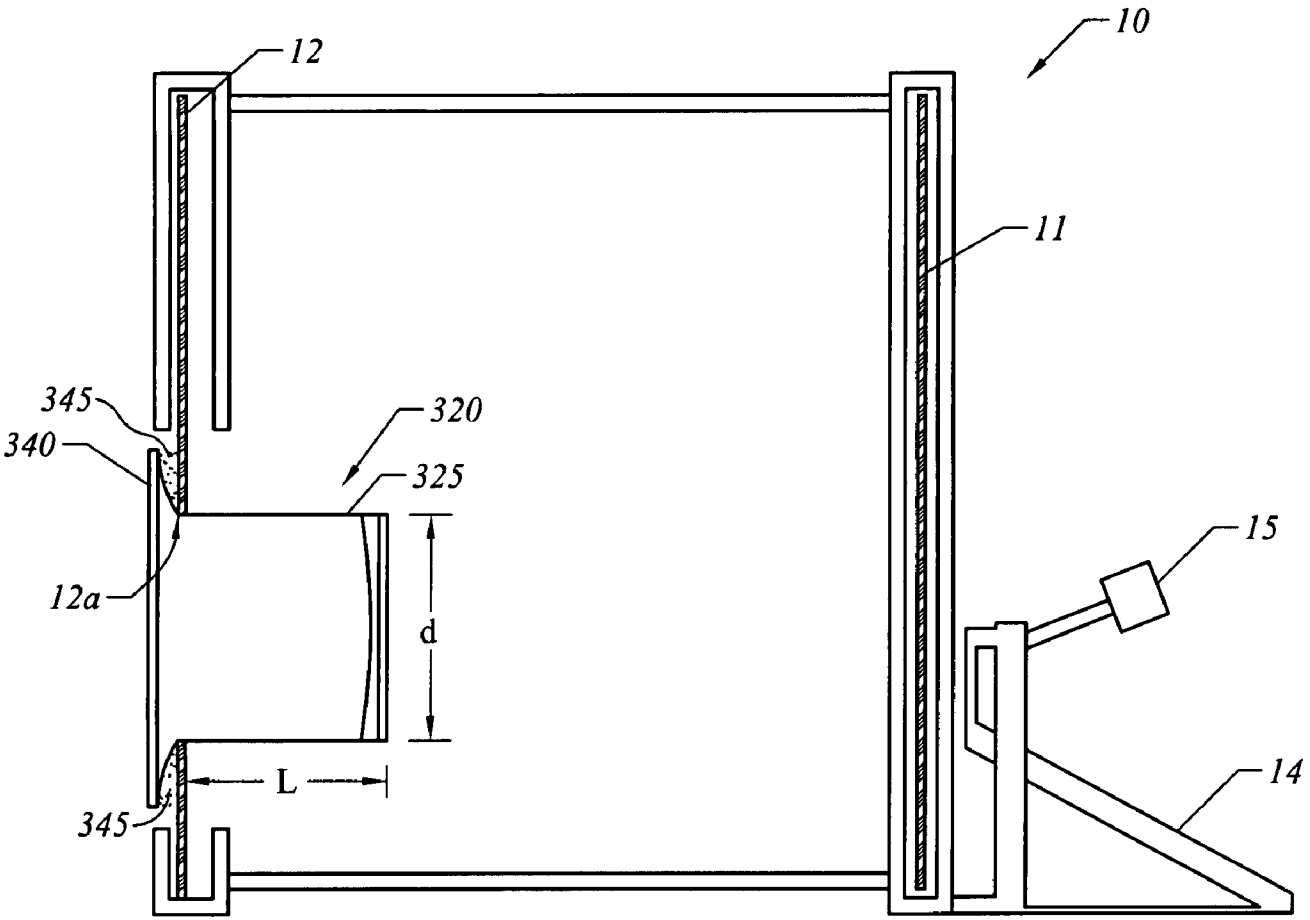
FIG. 7 is a schematic representation of a fourth embodiment of the invention.

FIG. 7 shows a fourth embodiment wherein insert 320 has a cylindrical body 325 and a flared outer end with flange 340. Adhesive 345 is applied between flange 340 and resonant membrane 12 to mount insert 320 to membrane 12. In this embodiment, adhesive 345 connects insert 320 to membrane 12 without any mechanical connector.

Other mounting means may be utilized to attach the cylindrical body and flange of the insert of this invention to the resonant membrane, including any mechanical connecting device and/or adhesive which securely attaches the insert and/or flange of the insert to the resonant membrane.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. An apparatus for maximizing the punch of a bass kick-drum and simultaneously minimizing the ringing of said drum, wherein said drum has a batter head membrane, a resonant membrane and a circular opening formed in said resonant membrane, comprising:

an insert, said insert having a cylindrically shaped body, said body being adapted to be slid into said opening in said resonant membrane, and mounting means for connecting said insert to said resonant membrane, wherein the weight of said insert and the length and diameter of said body of said insert are sized to maximize the punch of said drum and to simultaneously minimize the ringing of said drum.

2. The apparatus of claim 1 wherein said insert includes a flange at the outer end of said body.

3. The apparatus of claim 2 wherein said mounting means is removably attachable to said resonant membrane, said mounting means comprising a plurality of flexible fins carried by said body.

4. The apparatus of claim 3 wherein said flared flange carries a foam gasket and wherein said insert is connected to said resonant drumhead between said foam gasket and said flexible fins.

5. The apparatus of claim 3 wherein said flexible fins are attached tangentially around the periphery of said body.

6. The apparatus of claim 5 wherein said fins are rubber.

7. The apparatus of claim 2 wherein said mounting means is adhesive applied between said flange and said resonant membrane.

8. The apparatus of claim 1 wherein said insert includes a flared flange at the outer end of said body and a rubber sleeve having a peripheral flange at its forward end is carried by said cylindrical body, whereby said resonant membrane is held between said flared flange and said peripheral flange.

9. A method of optimizing the output sound of a bass drum, wherein the punch of the output sound is maximized and the ringing of the output sound is minimized, wherein said drum has a batter head membrane and a resonant membrane, a circular opening in said resonant membrane, and wherein an insert having a cylindrical body with a length and diameter is adapted to slide into said opening and be connected to said resonant membrane, and the weight of said insert is adjustable, comprising the steps:

adjusting the weight of said insert to lower the fundamental frequency of said resonant membrane, and simultaneously minimize ringing of said output sound, and sizing the length and diameter of said cylindrical body to cause momentary restriction of sound waves through said insert and through said opening in said resonant membrane, thereby maximizing the amplitude of vibration of said resonant membrane after said batter head membrane is struck.

* * * * *